US007586461B2

(12) United States Patent
Miyoshi et al.

(10) Patent No.: US 7,586,461 B2
(45) Date of Patent: Sep. 8, 2009

(54) ANTENNA UNIT HAVING IMPROVED ANTENNA RADIATION CHARACTERISTICS

(75) Inventors: Akira Miyoshi, Tokyo (JP); Takao Kato, Akita (JP); Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 225 days.

(21) Appl. No.: 11/412,547

(22) Filed: Apr. 27, 2006

(65) Prior Publication Data

US 2007/0024518 A1 Feb. 1, 2007

(30) Foreign Application Priority Data

Jul. 28, 2005 (JP) ..... 2005-219018
Dec. 22, 2005 (JP) ..... 2005-369430

(51) Int. Cl.
*H01Q 1/36* (2006.01)

(52) U.S. Cl. ..... 343/895; 343/702

(58) Field of Classification Search ..... 343/702, 343/895, 872

See application file for complete search history.

(56) References Cited

U.S. PATENT DOCUMENTS 5,357,261 A 10/1994 Brandigampola
5,838,285 A 11/1998 Tay et al.
5,986,620 A * 11/1999 Filipovic ..... 343/895
5,995,064 A * 11/1999 Yanagisawa et al. ..... 343/895
6,150,984 A 11/2000 Suguro et al.
6,278,414 B1 * 8/2001 Filipovic ..... 343/895
6,339,408 B1 * 1/2002 Edvardsson et al. ..... 343/895
6,424,316 B1 * 7/2002 Leisten ..... 343/895
6,429,830 B2 8/2002 Noro et al.
6,433,755 B1 8/2002 Kuramoto
6,587,081 B2 7/2003 Noro et al.
6,628,241 B1 9/2003 Fukushima et al.
6,642,893 B1 * 11/2003 Hebron et al. ..... 343/702
6,784,850 B2 8/2004 Morooka et al.
6,788,272 B2 * 9/2004 McCarthy et al. ..... 343/895
6,919,859 B2 7/2005 McCarthy et al.
7,262,745 B2 8/2007 Noro
7,295,172 B2 11/2007 Noro
7,324,062 B2 * 1/2008 Noro et al. ..... 343/895
2006/0018026 A1 1/2006 Bastawros et al.
2006/0022891 A1 2/2006 O'Neil, Jr. et al.
2006/0202904 A1 9/2006 Noro et al.
2007/0018905 A1 1/2007 Kato et al.

FOREIGN PATENT DOCUMENTS

JP 2001-339227 A 12/2001
JP 2001-339228 A 12/2001
JP 2003-37430 A 2/2003
JP 2003-298335 A 10/2003

* cited by examiner

*Primary Examiner*—HoangAnh T Le
(74) *Attorney, Agent, or Firm*—Frishauf, Holtz, Goodman & Chick, P.C.

(57) ABSTRACT

An antenna unit comprises a hollow cylindrical member obtained by forming a flexible insulating film member into a hollow cylinder about a center axis and an antenna pattern composed of a plurality of conductors formed on a peripheral surface of the hollow cylindrical member. The antenna pattern comprises a helical pattern extending helically in a direction of the center axis and a loop pattern connected to an end portion of the helical pattern at an upper end portion of the hollow cylindrical member.

8 Claims, 16 Drawing Sheets

ANTENNA UNIT HAVING IMPROVED ANTENNA RADIATION CHARACTERISTICS

This application claims priority to prior Japanese patent applications JP 2005-219018 and 2005-369430, the disclosures of which are incorporated herein by reference.

BACKGROUND OF THE INVENTION

This invention relates to a pole-type antenna unit and, in particular, to a pole-type and personal-type miniature antenna unit for a digital radio receiver for receiving an electric wave from an artificial satellite (that may be called a "satellite wave") or an electric wave on the ground (that may be called a "terrestrial wave") to listen in a digital radio broadcasting.

In recent years, a digital radio receiver, which receives the satellite wave or the terrestrial wave to listen the digital radio broadcasting, has been developed and is put to practical use in the United States of America. The digital radio receiver is generally mounted on a mobile station, such as an automobile, and can receive an electric wave having a frequency of about 2.3 gigahertz (GHz) to listen in a radio broadcasting. That is, the digital radio receiver is a radio receiver which can listen in a mobile broadcasting. Inasmuch as the received wave has the frequency of about 2.3 GHz, a reception wavelength (resonance frequency) $\lambda$ thereof is equal to about 128.3 mm. In addition, the terrestrial wave is an electric wave in which a signal where the satellite wave is received in an earth station is frequency shifted a little and is retransmitted in a linearly polarized wave. That is, the satellite wave is a circularly polarized wave, while the terrestrial wave is the linearly polarized wave.

As described above, since the electric wave having the frequency of about 2.3 GHz is used in the digital radio broadcasting, an antenna unit for receiving such an electric wave should be installed outdoors.

As digital radio receivers, there are a type adapted to be mounted in an automobile, a type adapted to be installed in a house or the like, and a type that is portable using a battery as a power source.

As a specific example of the portable digital radio receiver, there is available a portable electronic device such as a portable sound device. This portable electronic device comprises, in addition to a digital tuner for listening to the digital radio broadcasting, for example, an optical disk drive for reproducing an optical disk such as a compact disk (CD), an amplifier, and a speaker, which are integrally incorporated in a case.

On the other hand, there have been proposed antennas with various structures that are adapted to receive the electric wave having the frequency of about 2.3 GHz. Based on the shapes, they are roughly classified into a planar type (plate type) such as a patch antenna and a cylindrical type such as a loop antenna or a helical antenna. Such an antenna of the planar or cylindrical type is prepared as a separate member from the case of the foregoing portable electronic device and is connected to the digital radio tuner incorporated in the case through a cable and a connector so as to be used.

Generally, the antennas of the cylindrical type are more used than the antennas of the planar type because a wider directivity can be achieved by making the shape of the antenna cylindrical. As described above, the antennas of the cylindrical type are roughly classified into the loop antenna and the helical antenna.

As the loop antenna, there is known an electromagnetic coupling type four-point feeding loop antenna (see, e.g. Patent Document 1: Japanese Unexamined Patent Application Publication (JP-A) No. 2003-298335). The electromagnetic coupling type four-point feeding loop antenna disclosed in Patent Document 1 comprises a hollow cylindrical member formed by rolling a flexible insulating film member into a hollow cylinder about a center axis, a loop portion formed into a loop about the center axis on the hollow cylindrical member along its peripheral surface, and four feed lines for power feeding to the loop portion formed on the peripheral surface of the hollow cylindrical member. Four electromagnetic coupling lines are connected to the loop antenna such that each of them extends along the corresponding one of the four feed lines from the loop portion with a gap defined therebetween, thereby carrying out the power feeding through electromagnetic coupling. This loop antenna has a ground conductor pattern formed on the back of a circuit board extending in a direction perpendicular to the center axis.

On the other hand, the helical antenna is also known (see, e.g. Patent Document 2: Japanese Unexamined Patent Application Publication (JP-A) No. 2003-37430). Patent Document 2 proposes to produce a flexible insulating film member having one surface printed with an antenna pattern composed of four helical conductors (hereinafter referred to as an "antenna pattern printed insulating film member") and then roll the antenna pattern printed insulating film member into a hollow cylinder about a center axis such that the foregoing one surface becomes an outer peripheral surface, thereby manufacturing a helical antenna. This helical antenna also has a ground conductor pattern formed on the back of a circuit board extending in a direction perpendicular to the center axis.

In the case of each of the foregoing antennas of the cylindrical type, after a satellite wave (circularly polarized wave) is received from the loop portion through the four electromagnetic coupling lines or by the helical conductors as a plurality of received waves, the received waves are phase-shifted by a phase shifter so as to be matched (adjusted) in phase, thereby obtaining a combined wave, and then the combined wave is amplified by a low-noise amplifier (LNA) and sent to a receiver body. Herein, a combination of the helical antenna, the phase shifter, and the LNA is called an antenna unit.

On the other hand, there has also been proposed an antenna unit comprising a helical antenna in the form of an antenna pattern formed on an outer peripheral surface of a cylindrical member, and a phase shifter in the form of a phase shifter pattern formed on the outer peripheral surface of the cylindrical member so as to be continuous with (connected to) the antenna pattern (see, e.g. Japanese Unexamined Patent Application Publication (JP-A) No. 2001-339228).

Such an antenna unit is placed in a topped hollow cylindrical cover case (cylinder) in order to prevent water invasion. Accordingly, the external appearance of the overall antenna unit exhibits a pole shape. In view of this, the antenna unit having such external appearance is called a pole-type antenna unit. Since the pole-type antenna unit is used while being carried, i.e. clipped to a pocket or the like, it is disposed in close proximity to the human body.

In the case where the foregoing electromagnetic coupling type four-point feeding loop antenna is used as the antenna of the cylindrical type, electric wave radiation of the same intensity occurs in upward and downward directions if there is no ground conductor pattern with a certain size extending in the direction perpendicular to the center axis. Specifically, with respect to cross polarization, assuming that there is left-hand circular polarization in the upward direction, there is, in the downward direction, right-hand circular polarization whose intensity is equal to that of the left-hand circular polarization.

However, in the pole-type antenna unit, there is no space for providing such a ground conductor pattern extending in the direction perpendicular to the center axis.

Further, as described above, in the electromagnetic coupling type four-point feeding loop antenna, the power feeding to the loop portion is electromagnetically carried out from the four electromagnetic coupling lines through the four feed lines with the gaps defined therebetween. Therefore, the gaps should be accurately set and, thus, there is a problem that it is complicated to achieve impedance matching.

Moreover, when applied to any of mobile, vehicular, and portable receivers, the pole-type antenna unit is required to have as small a size as possible particularly in the center axis direction of the pole.

In addition, when applied to the portable receiver, the influence of a human body, for example, a shift in resonant frequency, tends to occur while the receiver is held in hand.

SUMMARY OF THE INVENTION

It is therefore an object of this invention to provide a pole-type antenna unit that can improve antenna radiation characteristics even if there is no ground conductor pattern extending in a direction perpendicular to a center axis.

It is another object of this invention to provide a pole-type antenna unit that can easily achieve impedance matching.

It is still another object of this invention to provide a pole-type antenna unit that can reduce the size, particularly the size in a center axis direction of a pole, as much as possible.

It is yet still another object of this invention to provide a pole-type antenna unit that is hardly affected by a human body even when applied to a portable receiver.

An antenna unit according to this invention comprises a pole-shaped member and an antenna pattern composed of a plurality of conductors formed on a peripheral surface of the pole-shaped member.

According to an aspect of this invention, the antenna pattern comprises a helical pattern extending helically in a direction of the center axis and a loop pattern connected to an end portion of the helical pattern at an upper end portion of the pole-shaped member.

In the antenna unit, it is preferable that the pole-shaped member is a hollow cylindrical member obtained by forming a flexible insulating film member into a hollow cylinder about a center axis. It is preferable that helical pattern comprises a bent portion that is bent at least once in an opposite direction in the direction of the center axis. Also, it is preferable that antenna unit further comprises a phase shifter pattern formed on the peripheral surface of the pole-shaped member and electrically connected to the helical pattern. It is preferable that the antenna pattern and the phase shifter pattern are formed on an inner peripheral surface of the pole-shaped member. In this case, the antenna unit may further comprise a ground pattern formed on an outer peripheral surface of the pole-shaped member at a portion corresponding to a portion where the phase shifter pattern is formed. The antenna unit may further comprise a hollow cylindrical cover case covering the pole-shaped member. At least part of a helically extending portion of the helical pattern may be formed in a meander shape.

According to the antenna unit of this invention, since the antenna pattern is composed of the combination of the helical pattern and the loop pattern, even if there is no ground conductor pattern extending in a direction perpendicular to the center axis, the antenna radiation characteristics can be improved and the impedance matching can be easily achieved.

In the helical pattern, the portion extending helically has the bent portion that is bent at least once in the opposite direction in the center axis direction and at least part of the helically extending portion is formed in the meander shape, so that the size in the center axis direction can be reduced.

BRIEF DESCRIPTION OF THE DRAWINGS

FIGS. 2A and 2B are developed views each of an antenna pattern portion and a phase shifter portion used in the pole-type antenna unit illustrated in FIG. 1, wherein FIG. 2A is a plan view showing a first surface (inner peripheral surface) and FIG. 2B is a plan view showing a second surface (outer peripheral surface);

FIGS. 7A, 7B, and 7C are diagrams showing a packing used in the pole-type antenna unit illustrated in FIG. 1, wherein FIG. 7A is a front view, FIG. 7B is a plan view, and FIG. 7C is a sectional view taken along line B-B in FIG. 7B;

FIGS. 15A and 15B are diagrams for explaining cross polarization characteristics (radiation pattern) of the antenna unit according to the first embodiment of this invention, wherein FIG. 15A is a transparent perspective view of the antenna unit according to this invention and FIG. 15B is a diagram showing a radiation pattern of the antenna unit according to this invention;

FIGS. 16A and 16B are diagrams for explaining cross polarization characteristics (radiation pattern) of a conventional antenna unit, wherein FIG. 16A is a transparent perspective view of the conventional antenna unit and FIG. 16B is a diagram showing a radiation pattern of the conventional antenna unit;

FIGS. 17A and 17B are developed views each of an antenna pattern portion and a phase shifter portion used in a pole-type antenna unit according to a second embodiment of this invention, wherein FIG. 17A is a plan view showing a first surface (inner peripheral surface) and FIG. 17B is a plan view showing a second surface (outer peripheral surface)

DESCRIPTION OF THE PREFERRED EMBODIMENT

Now, an embodiment of this invention will be described in detail with reference to the drawings.

First Embodiment

Figure 1:
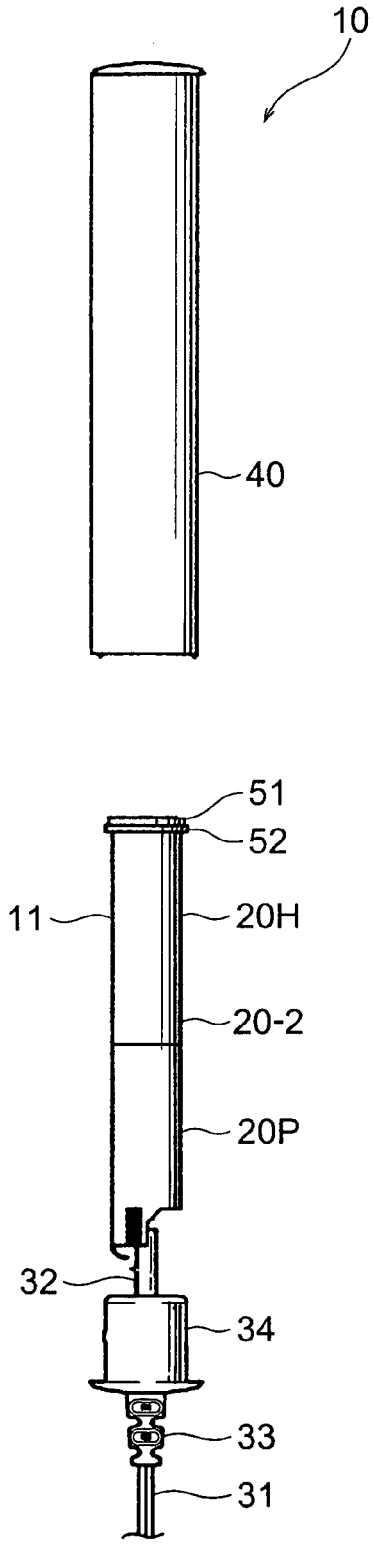
FIG. 1 is a schematic exploded view showing a pole-type antenna unit according to a first embodiment of this invention.
Figure 2B:
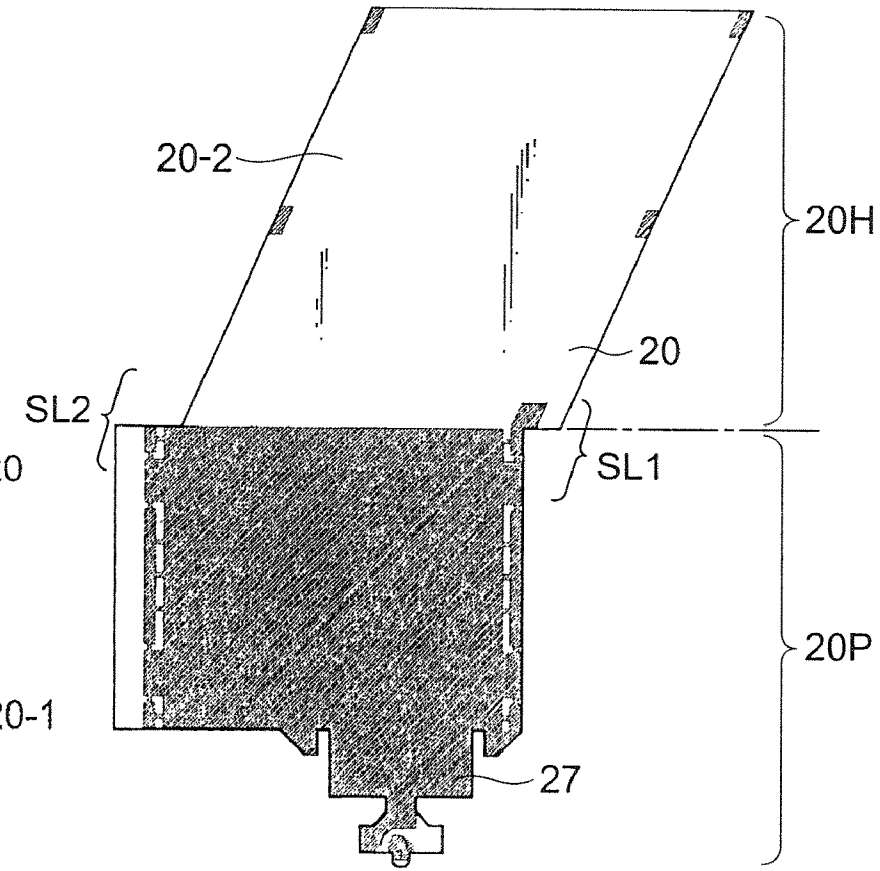
Figure 2A:
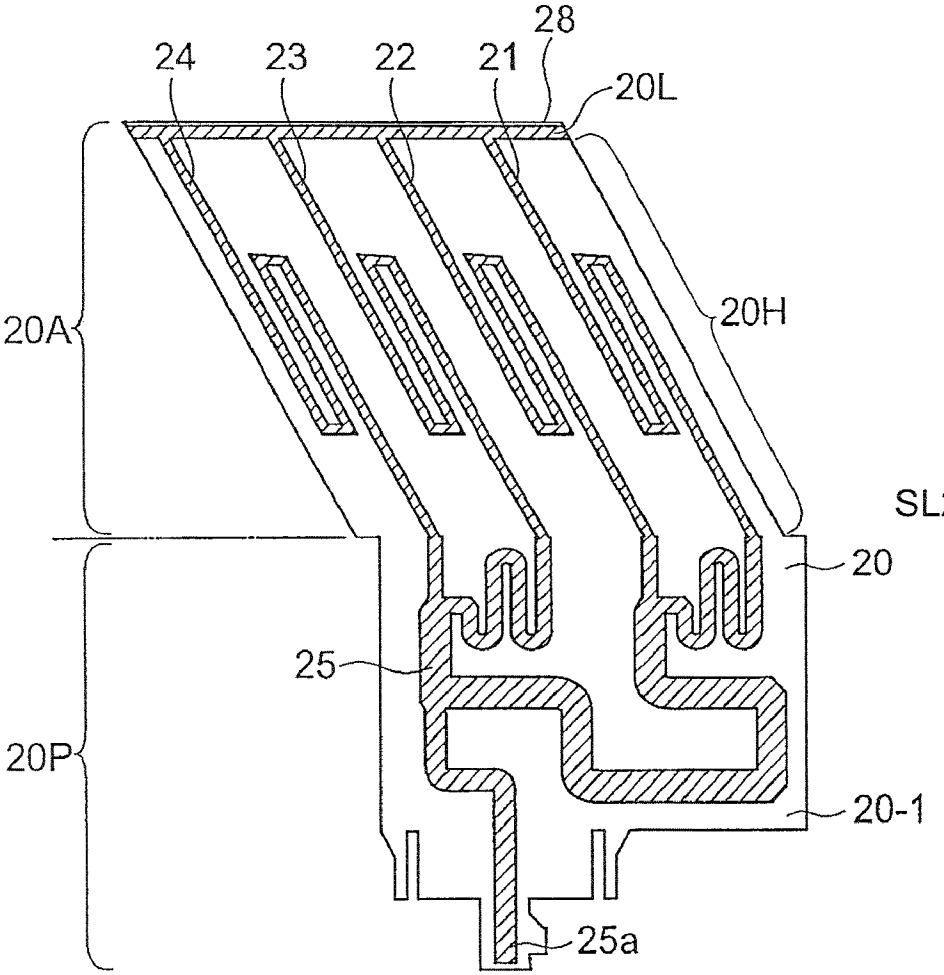

Referring to FIG. 1 and FIGS. 2A and 2B, description will be made about a pole-type antenna unit 10 according to the embodiment of this invention. The pole-type antenna unit 10 is an antenna unit for a digital radio receiver and is connected to a digital radio tuner (not shown) incorporated in a housing of a portable electronic device (not shown) through a cable 31 and a connector (not shown) so as to be used.

The pole-type antenna unit 10 comprises a hollow cylindrical member 11 formed by rolling a flexible insulating film member 20 about a center axis as shown in FIGS. 2A and 2B into a hollow cylinder. FIG. 2A shows a first surface 20-1 of the insulating film member 20 while FIG. 2B shows a second surface 20-2 of the insulating film member 20. The insulating film member 20 is composed of an antenna pattern portion 20A and a phase shifter portion 20P. The antenna pattern portion 20A has a substantially parallelogram shape while the phase shifter portion 20P has a substantially rectangular shape.

The antenna pattern 20A comprises a helical pattern portion 20H formed so as to extend helically in a longitudinal direction (direction of the center axis) of the pole-type antenna unit 10 and a loop pattern portion 20L connected to an end portion of the helical pattern portion 20H at an upper end portion of the hollow cylindrical member 11.

By connecting together a pair of lateral sides SL1 and SL2 of the insulating film member 20 so that the first surface 20-1 becomes an inner peripheral surface, the hollow cylindrical member 11 as shown in FIG. 1 is formed. The connection between the pair of lateral sides is carried out, for example, by the use of double-sided adhesive tape, an adhesive agent, or soldering.

A first antenna pattern comprising first to fourth helical conductors 21, 22, 23, and 24 is formed on the first surface 20-1 of the helical antenna portion 20H. Each of the first to fourth helical conductors 21 to 24 is formed so as to extend in parallel to the lateral sides of the helical antenna portion 20H in the state where each conductor is bent twice in opposite directions in the longitudinal direction (direction of the center axis) of the pole-type antenna unit 10. Therefore, when the insulating film member 20 is rolled so that the hollow cylindrical member 11 is formed as described above, each of the first to fourth helical conductors 21 to 24 extends in a helical fashion on the inner peripheral surface of the hollow cylindrical member 11 in the state where each conductor is bent twice in the opposite directions in the longitudinal direction (direction of the center axis) of the pole-type antenna unit 10. The first antenna pattern composed of the first to fourth helical conductors 21 to 24 functions as a helical antenna.

As described above, in this first embodiment, the first to fourth helical conductors 21 to 24 are each bent in the longitudinal direction of the pole-type antenna unit 10 and, therefore, the height of the pole-type antenna unit 10 can be reduced as compared with the case where the helical conductors are not bent.

A second antenna pattern comprising a loop conductor 28 connected to end portions (upper end portions) of the first to fourth helical conductors 21 to 24 is formed on the first surface 20-1 of the loop antenna portion 20L. The second antenna pattern comprising the loop conductor 28 functions as a loop antenna.

A phase shifter pattern 25 electrically connected to the foregoing first antenna pattern is formed on the first surface 20-1 of the phase shifter portion 20P. Therefore, when the insulating film member 20 is rolled so that the hollow cylindrical member 11 is formed as described above, the phase shifter pattern 25 is formed on the inner peripheral surface of the hollow cylindrical member 11. This phase shifter pattern 25 functions as a phase shifter.

A ground pattern 27 is formed on the second surface 20-2 of the phase shifter portion 20P. That is, the ground pattern 27 is formed on the surface of the phase shifter portion 20P on the opposite side with respect to the surface thereof where the phase shifter pattern 25 is formed. Therefore, when the insulating film member 20 is rolled so that the hollow cylindrical member 11 is formed as described above, the ground pattern 27 is formed on the outer peripheral surface of the hollow cylindrical member 11 on the opposite side with respect to the surface thereof where the phase shifter pattern 25 is formed. The ground pattern 27 functions as a shield member provided so as to cover the phase shifter pattern 25.

The pole-type antenna unit 10 further comprises a topped hollow cylindrical cover case (cylinder) 40 covering the hollow cylindrical member 11. The inner diameter of the cover case 40 is greater than the diameter of the hollow cylindrical member 11.

As described above, in this first embodiment, since the first antenna pattern comprising the first to fourth helical conductors 21 to 24 and forming the helical antenna portion 20H and the second antenna pattern comprising the loop conductor 28 and forming the loop antenna portion 20L are formed on the inner peripheral surface 20-1 of the hollow cylindrical member 11, there is no direct contact between the first and second antenna patterns and an inner wall of the cover case 40. Therefore, antenna characteristics of the pole-type antenna unit 10 can be prevented from being affected by the cover case 40. Further, since the ground pattern 27 serving as the shield member is disposed on the outer side of the phase shifter pattern 25, the antenna characteristics of the pole-type antenna unit 10 can be prevented from being affected by the human body. As a result, the pole-type antenna unit 10 according to this first embodiment can achieve desired antenna characteristics even during use.

Figure 3:
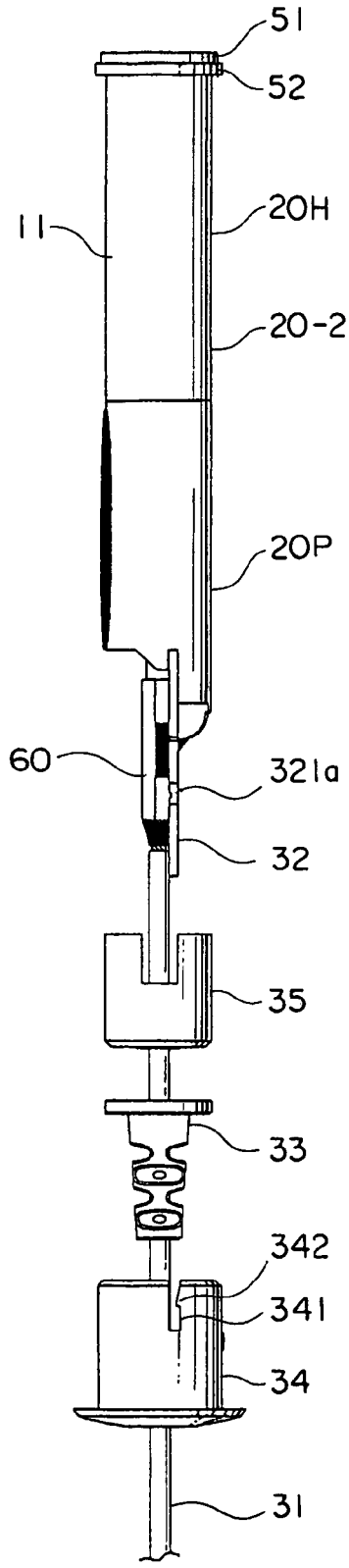
FIG. 3 is an exploded rear view showing the pole-type antenna unit illustrated in FIG. 1 with a cover case removed.

In the illustrated embodiment, a first annular cushion member 51 is wound around the antenna pattern portion 20A at its tip end as shown in FIG. 3. Further, just below the first annular cushion member 51, a second annular cushion member 52 is wound around the antenna pattern portion 20A. The thickness of the second annular cushion member 52 is slightly greater than a clearance between the hollow cylindrical member 11 and the cover case 40. The first and second annular cushion members 51 and 52 are made of, for example, urethane foam.

By winding the first annular cushion member 51 around the antenna pattern portion 20A at its tip end as described above, it is possible to change permittivity of the antenna pattern portion 20A at its tip end, thereby enabling adjustment of antenna frequency characteristics of the pole-type antenna unit 10. Therefore, by changing the thickness or width of the first annular cushion member 51, it is possible to change the antenna frequency characteristics of the pole-type antenna unit 10.

On the other hand, the second annular cushion member 52 serves as a cushion between the inner wall of the cover case 40 and the antenna pattern portion 20A so that the clearance between the inner wall of the cover case 40 and the antenna pattern portion 20A can be maintained constant. Accordingly, since it is possible to prevent an extreme inclination of the antenna pattern portion 20A with respect to the cover case 40, variation in directivity of the pole-type antenna unit 10 can be suppressed. As described above, since the thickness of the second annular cushion member 52 is slightly greater than the clearance between the antenna pattern portion 20A and the inner wall of the cover case 40, the second annular cushion member 52 is press-fitted into the cover case 40. As a result, the distance between the inner wall of the cover case 40 and the antenna pattern portion 20A can be held constant.

The pole-type antenna unit 10 comprises a board 32, such as a printed circuit board. An electronic component, such as a low-noise amplifier (LNA), is mounted on the board 32. The low-noise amplifier is connected to an output terminal 25*a* of the phase shifter pattern 25 and one end of the cable 31.

A satellite wave (circularly polarized wave) is received by the loop conductor 28 of the loop antenna portion 20L and the four conductors 21 to 24 of the helical antenna portion 20H as a plurality of received waves. The received waves are phase-shifted by the phase shifter pattern 25 so as to be matched (adjusted) in phase, thereby obtaining a combined wave. Then, the combined wave is amplified by the low-noise amplifier and sent to a receiver unit (not shown) through the cable 31.

Figure 4:
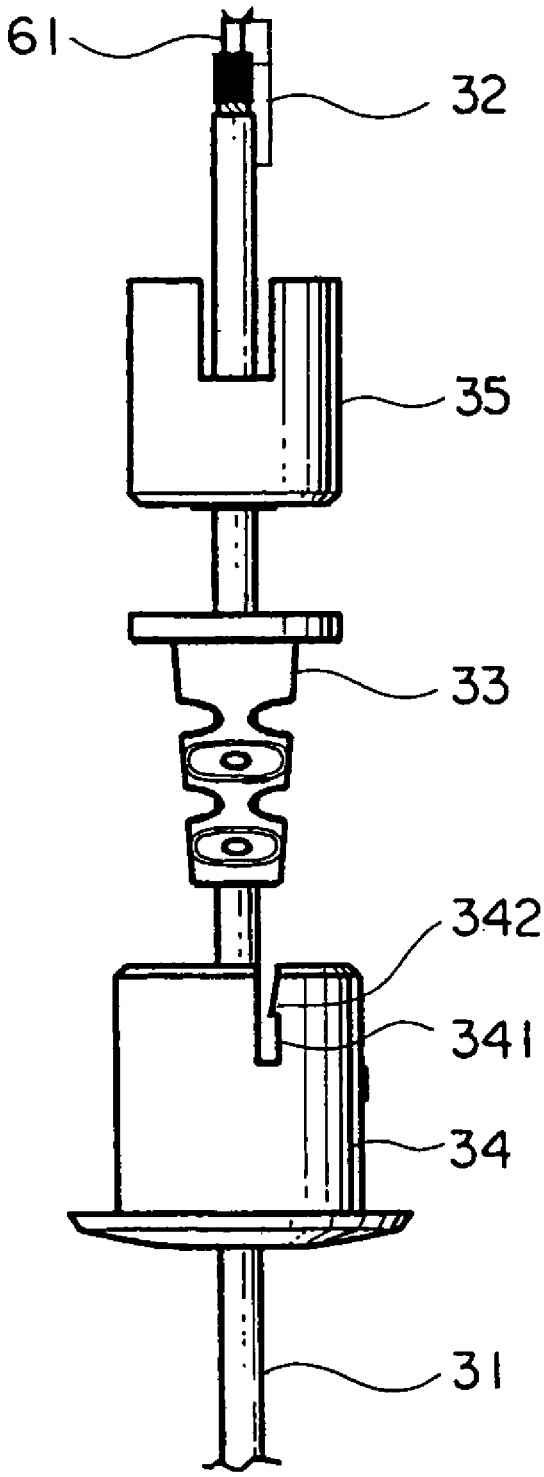
FIG. 4 is an exploded rear view showing the pole-type antenna unit illustrated in FIG. 3 with a hollow cylindrical member removed.
Figure 5:
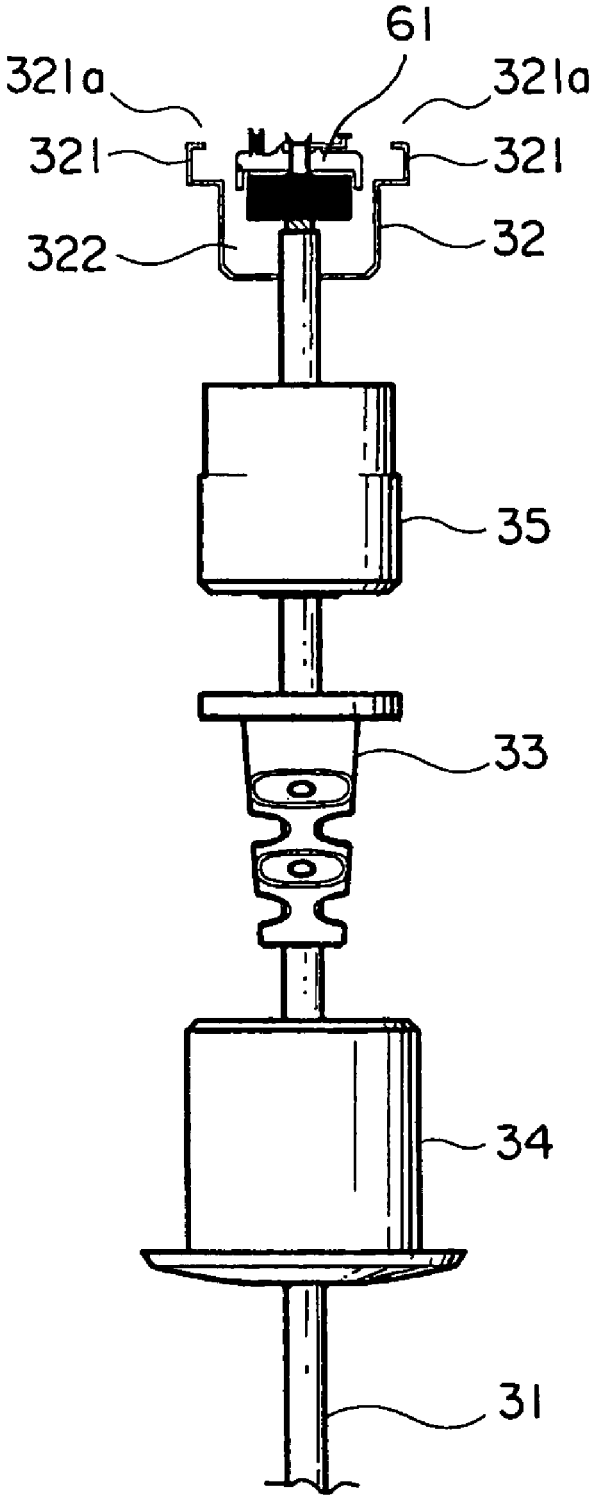
FIG. 5 is an exploded side view of the pole-type antenna unit illustrated in FIG. 4.

Referring also to FIGS. 3 to 5 in addition to FIG. 1, the pole-type antenna unit 10 further comprises a boot 33 slidably attached to the cable 31, an undercap (bottom cover) 34 that is attached to a lower end of the cover case 40 as will be described later, and a waterproof packing 35. The boot 33 is made of polyurethane.

By disposing the boot 33 and the packing 35 in the undercap 34 and inserting the board 32 therein, there are provided a waterproof function on the cable 31 and a board fixing function.

Figure 6:
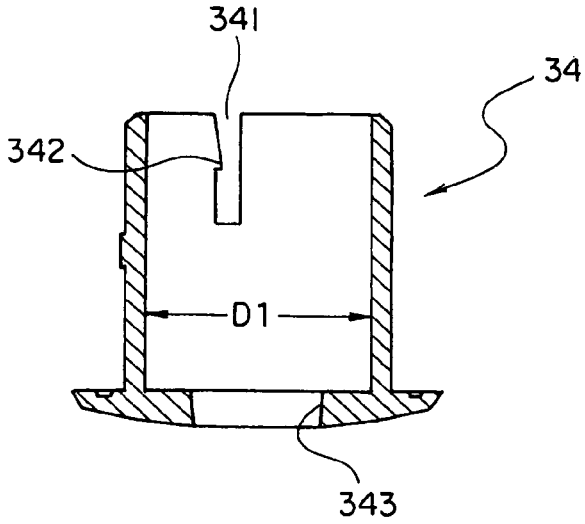
FIG. 6 is a sectional view of an undercap used in the pole-type antenna unit illustrated in FIG. 1.

FIG. 6 is a sectional view of the undercap 34. As shown in FIG. 6, the undercap 34 is formed with a pair of cutouts 341 on its upper end side for receiving therein both side end portions 321 (FIG. 5) of the board 32. The undercap 34 is provided with a pawl 342 at each of the cutouts 341 in order to prevent the board 32 from returning back upon press-fitting thereof. Further, the undercap 34 is formed at its lower end with an opening 343 in which the boot 33 is inserted.

As described above, the board 32 has the side end portions 321 projecting laterally from its both side surfaces. As shown in FIG. 3, each side end portion 321 of the board 32 is formed with a cutout 321*a* for engagement with the corresponding pawl 342 of the undercap 34.

Figure 7A:
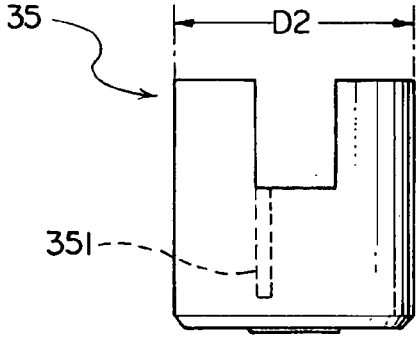
Figure 7B:
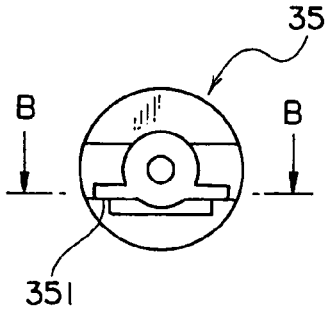
Figure 7C:
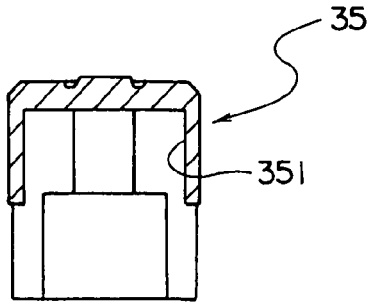

FIGS. 7A, 7B, and 7C are diagrams showing the packing 35, wherein FIG. 7A is a front view, FIG. 7B is a plan view, and FIG. 7C is a sectional view taken along line B-B in FIG. 7B. As shown in FIGS. 6 and 7A, an outer diameter D2 of the packing 35 is slightly greater than an inner diameter D1 of the undercap 34. The packing 35 is formed with a cutout 351 in which a lower end portion 322 (FIG. 5) of the board 32 is inserted.

By press-fitting the packing 35 into the undercap 34 and fixing such a press-fitted state by the board 32, the waterproof function on the cable 31 is realized. In this event, since the board 32 is also fixed in the undercap 34, positioning of the board 32 can also be carried out.

Figure 8:
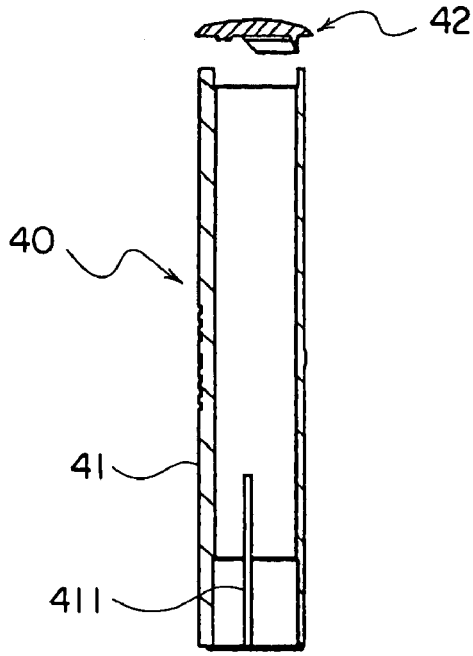
FIG. 8 is an exploded front sectional view of the pole-type antenna unit illustrated in FIG. 1.
Figure 8:
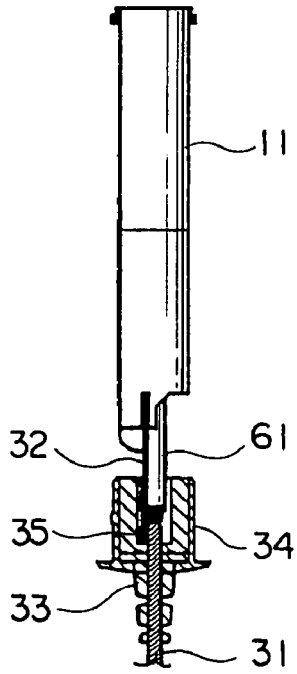

Referring to FIG. 8, the cover case 40 comprises a cylinder portion 41 and a top cover 42. The cylinder portion 41 is formed on its inner wall with a pair of grooves 411 for receiving therein the side end portions 321 of the board 32.

Figure 9:
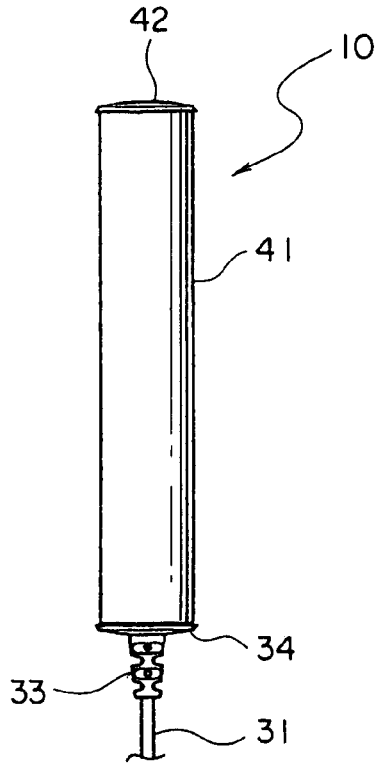
FIG. 9 is a front view showing the external appearance of the pole-type antenna unit illustrated in FIG. 1.
Figure 10:
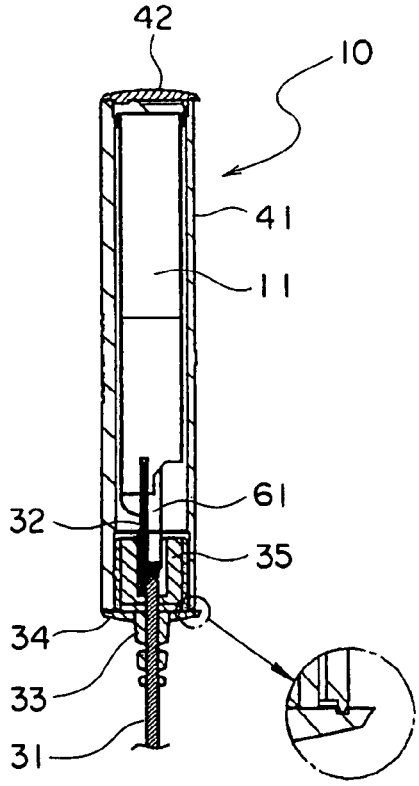
FIG. 10 is a front sectional view of the pole-type antenna unit illustrated in FIG. 1.
Figure 11:
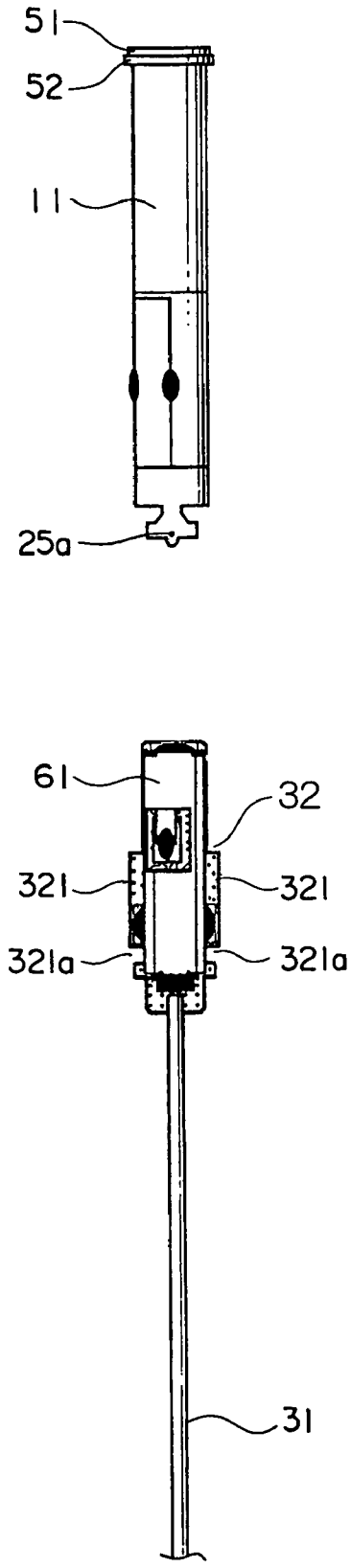
FIG. 11 is an exploded side view for explaining a positional relationship between a board and the hollow cylindrical member used in the pole-type antenna unit illustrated in FIG. 1.
Figure 12:
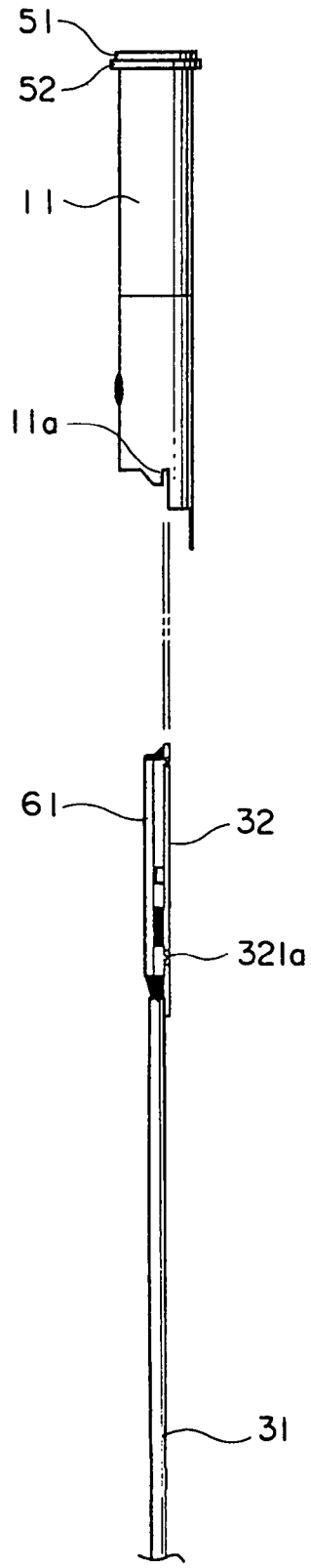
FIG. 12 is an exploded rear view for explaining the positional relationship between the board and the hollow cylindrical member illustrated in FIG. 11.

FIG. 9 is a front view showing the external appearance of the pole-type antenna unit 10 and FIG. 10 is a sectional view of the pole-type antenna unit 10. The top cover 42 is bonded to an upper end of the cylinder portion 41 by ultrasonic bonding. The undercap (bottom cover) 34 is bonded to a lower end of the cylinder portion 41 by ultrasonic bonding. Since, as described above, the pole-type antenna unit 10 has the structure using no screws, it is possible to reduce the number of components.

Referring to FIGS. 11 to 14, description will be made about a positional relationship between the board 32 and the hollow cylindrical member 11. The hollow cylindrical member 11 has a pair of cutouts 11*a* for receiving therein the side end portions 321 of the board 32.

Figure 13:
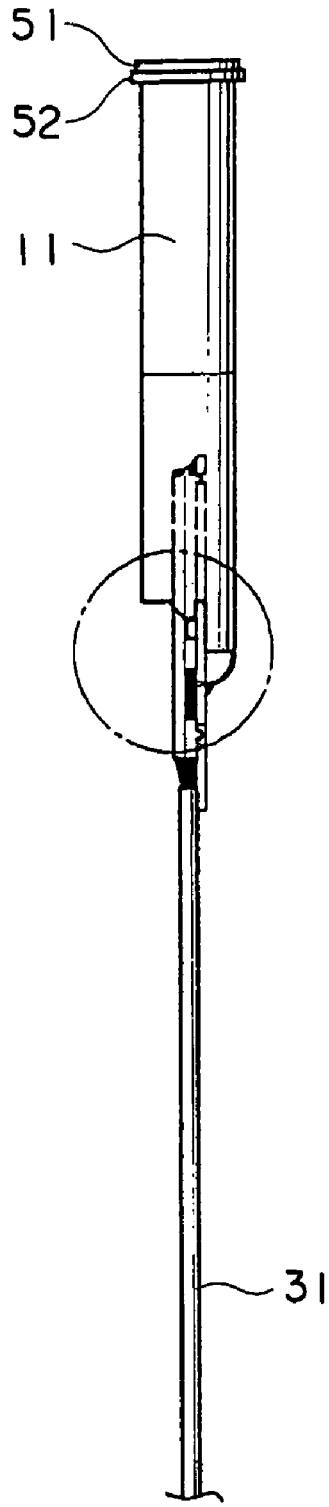
FIG. 13 is a rear view showing the state where the board and the hollow cylindrical member illustrated in FIG. 11 are assembled together.
Figure 14:
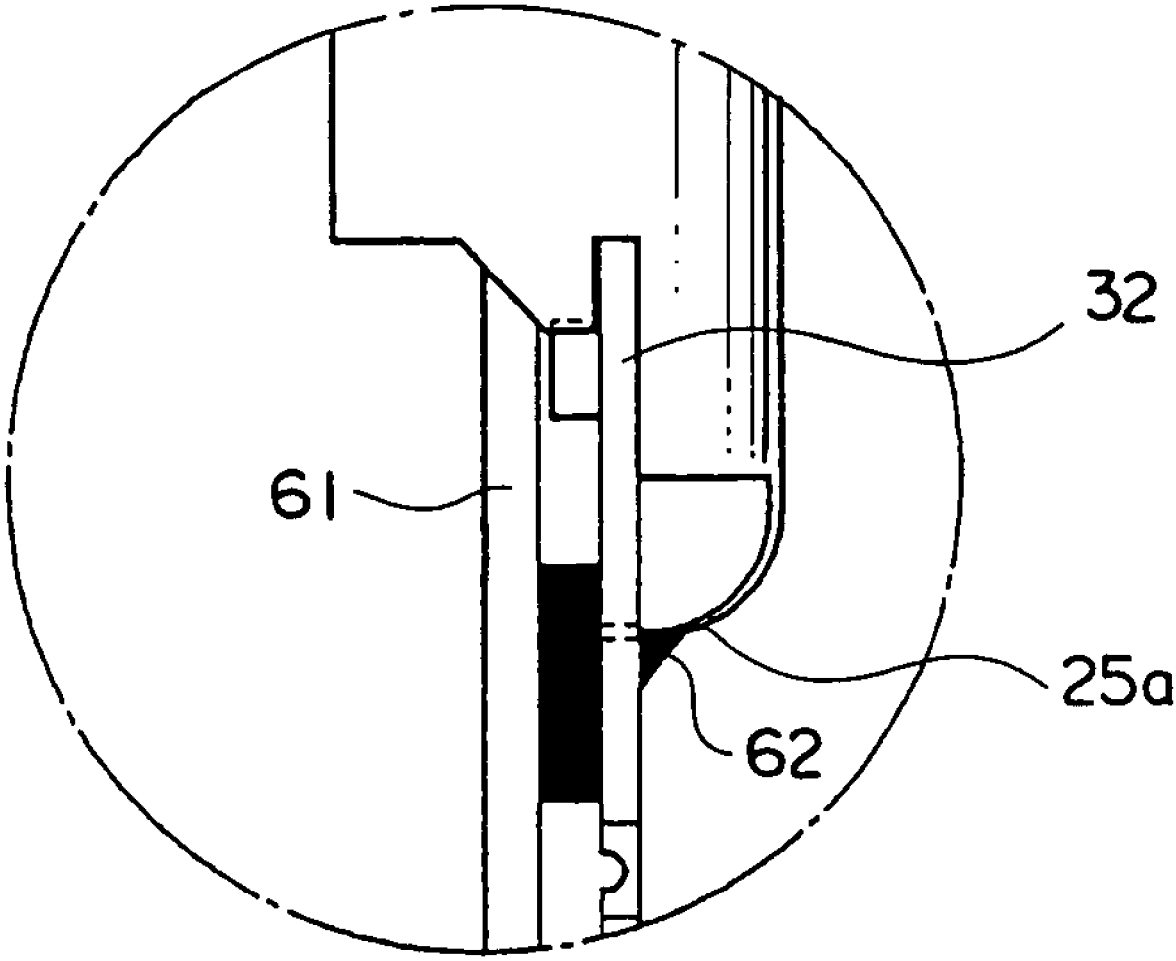
FIG. 14 is an enlarged view of an encircled portion in FIG. 13.

As shown in FIG. 13, part of the board 32 mounted with a low-noise amplifier (LNA) 61 (FIG. 11) is inserted into the inside of the hollow cylindrical member 11. As shown in FIG. 14, the output terminal 25*a* of the hollow cylindrical member 11 is connected to the board 32 (low-noise amplifier 61) by solder 62.

Since the part of the board 32 is inserted into the inside of the hollow cylindrical member 11 as described above, it is possible to reduce the size of the pole-type antenna unit 10 in its longitudinal direction. Further, since the connection between the hollow cylindrical member 11 and the board 32 (low-noise amplifier 61) is carried out by the use of the output terminal 25*a* formed at the flexible insulating film member 20, the particular or dedicated terminal component required in the conventional pole-type antenna unit becomes unnecessary and, therefore, it is possible to reduce the number of components.

Figure 15A:
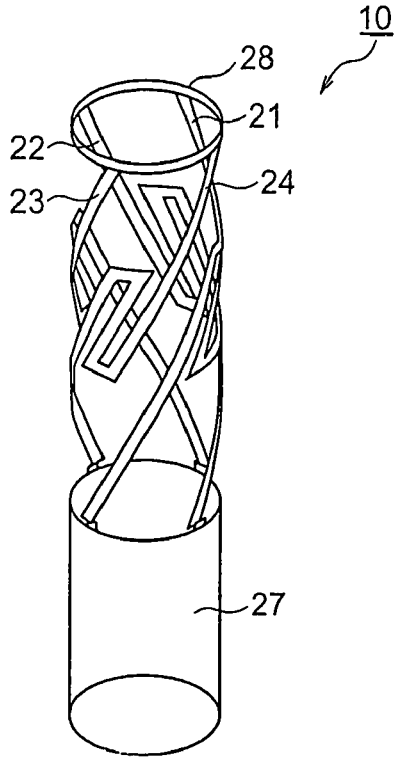
Figure 15B:
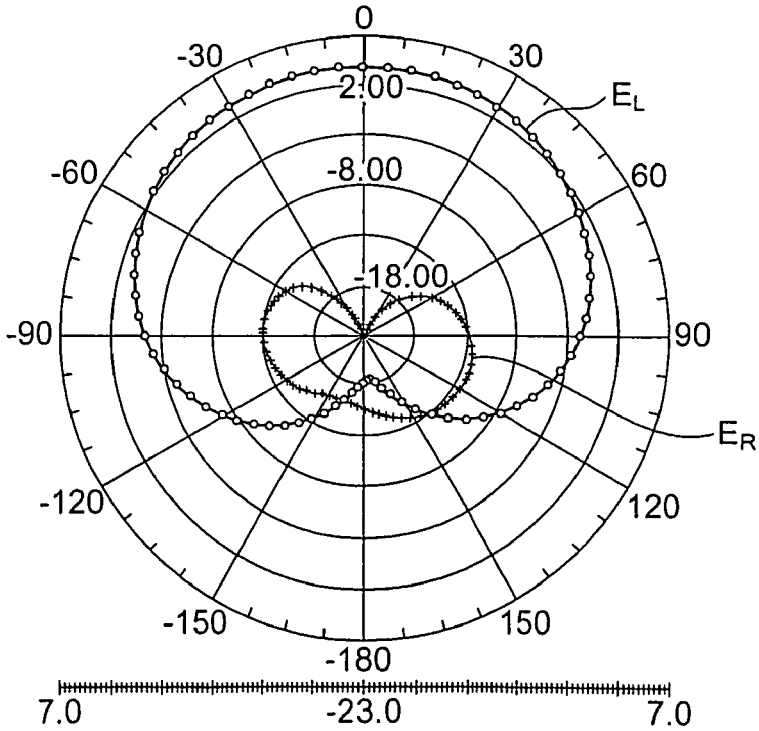

FIGS. 15A and 15B show cross polarization characteristics (radiation pattern) of the antenna unit 10 according to the first embodiment. FIG. 15A is a transparent perspective view of the antenna unit 10 according to the first embodiment and FIG. 15B is a diagram showing a radiation pattern of the antenna unit 10. As shown in FIG. 15B, the radiation pattern of the antenna unit 10 is composed of a radiation pattern of left-hand circular polarization $E_L$ and a radiation pattern of right-hand circular polarization $E_R$.

Figure 16A:
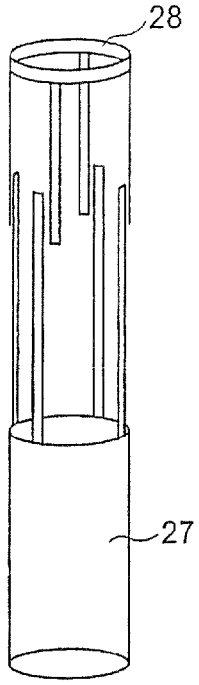
FIG. 16A PRIOR ART
Figure 16B:
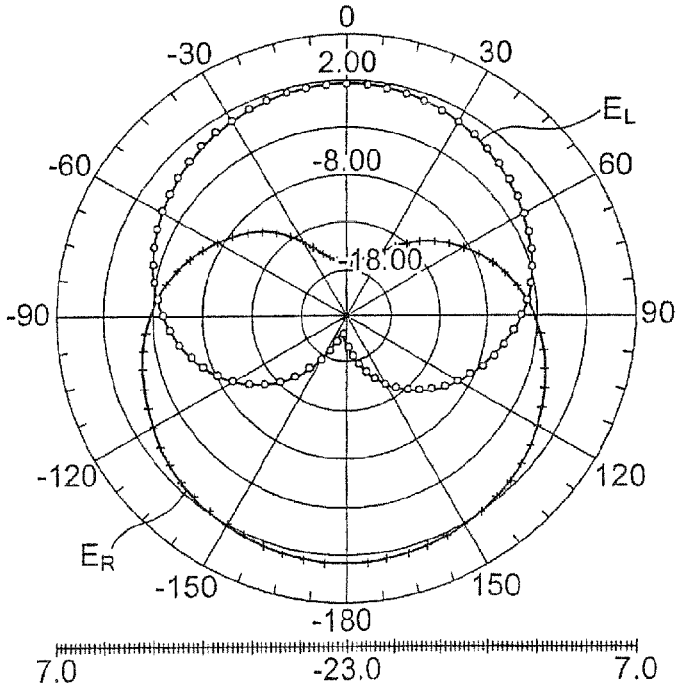
FIG. 16B PRIOR ART

As a reference example, FIGS. 16A and 16B show cross polarization characteristics (radiation pattern) of a conventional antenna unit having only a loop antenna. FIG. 16A is a transparent perspective view of the conventional antenna unit and FIG. 16B is a diagram showing a radiation pattern of the conventional antenna unit. As shown in FIG. 16B, the radiation pattern of the conventional antenna unit is also composed of a radiation pattern of left-hand circular polarization $E_L$ and a radiation pattern of right-hand circular polarization $E_R$.

As shown in FIG. 16B, it is understood that, in the conventional antenna unit, the left-hand circular polarization $E_L$ is radiated upward and the right-hand circular polarization $E_R$ having an intensity substantially equal to that of the left-hand circular polarization $E_L$ is radiated downward.

In contrast, as shown in FIG. 15B, it is understood that, in the antenna unit 10 according to the first embodiment, the radiation intensity of the left-hand circular polarization $E_L$ radiated upward is increased while the radiation intensity of the right-hand circular polarization $E_R$ radiated downward is reduced. That is, the electric wave is mainly radiated upward in the antenna unit 10 according to the first embodiment. Therefore, even if there is no ground conductor pattern extending in the direction perpendicular to the center axis, the antenna radiation characteristics of the antenna unit 10 can be improved. In other words, by combining the loop antenna and the helical antenna, it is possible to improve the antenna radiation characteristics when there is no ground conductor pattern.

Further, in the conventional antenna unit, four electromagnetic coupling lines are coupled to a loop conductor 28 through gaps defined therebetween as shown in FIG. 16A. In contrast, in the antenna unit 10 according to the first embodiment, the first to fourth helical conductors 21 to 24 are directly connected to the loop conductor 28 as shown in FIG. 15A and, therefore, the impedance matching can be easily achieved.

The antenna radiation characteristics of the antenna unit 10 can be changed to some degree by changing, on a design basis, a diameter of the loop conductor 28 and/or an angle of the first to fourth helical conductors 21 to 24.

Second Embodiment

Figure 17B:
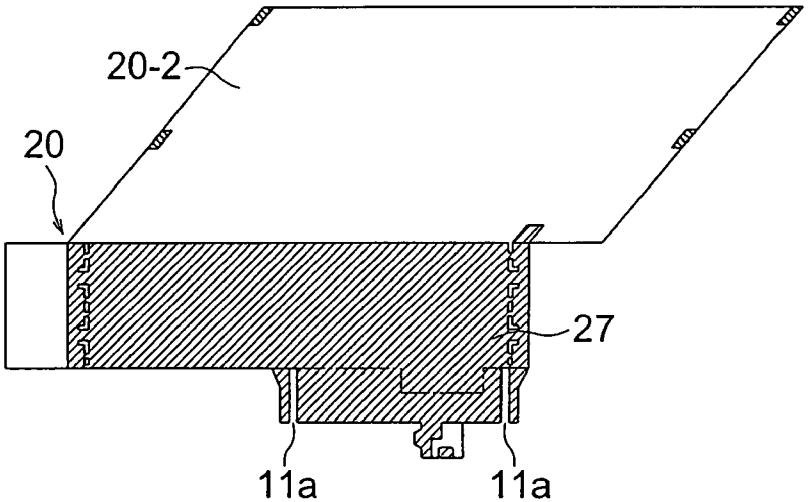
Figure 17A:
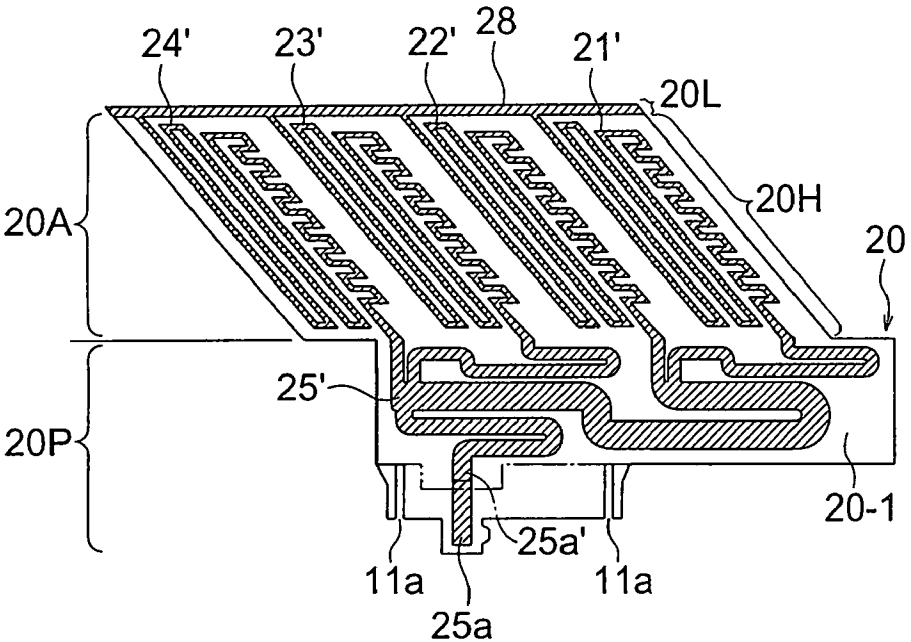
Figure 18:
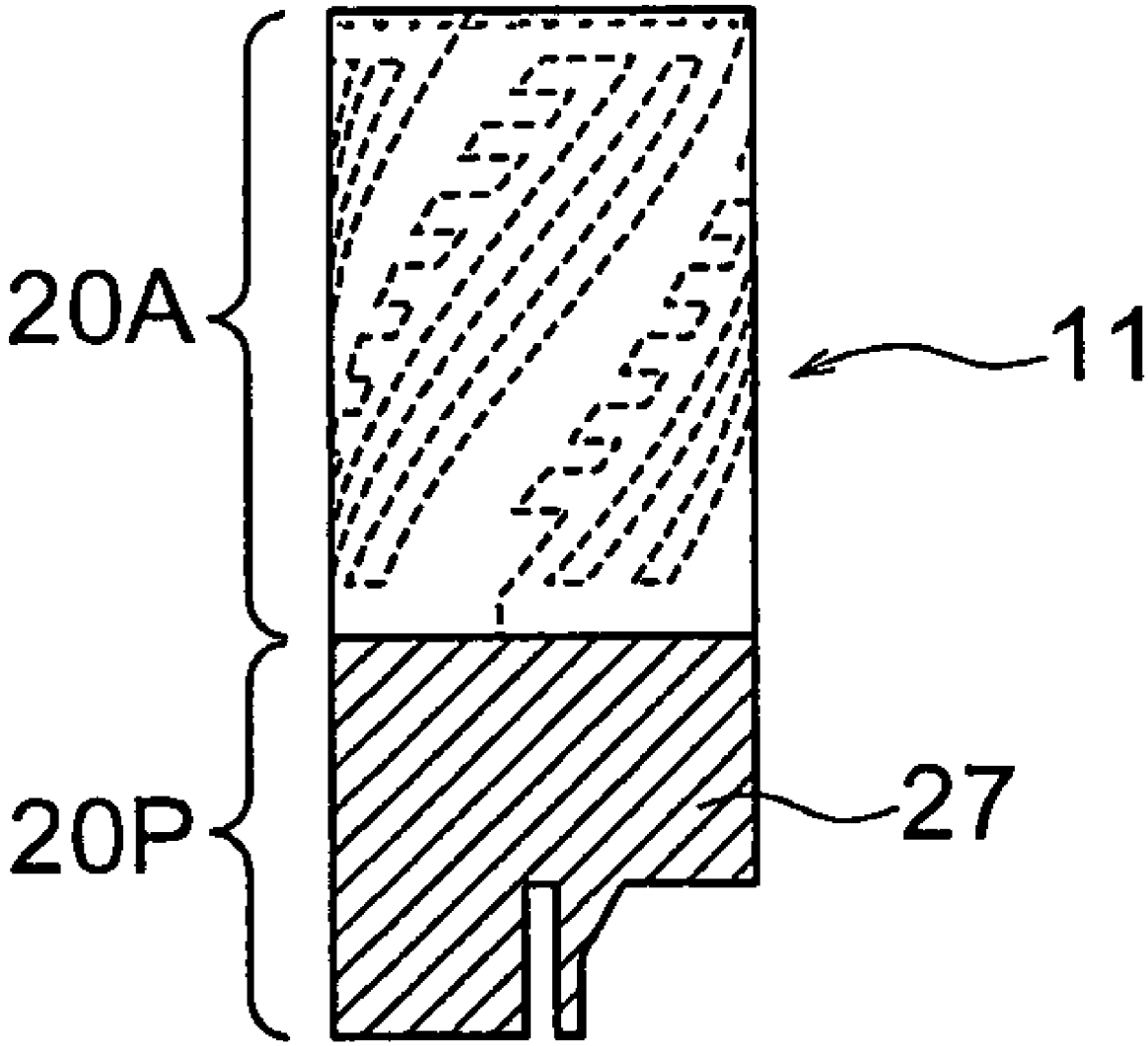
FIG. 18 is a diagram showing the external appearance when an insulating film member having a conductor pattern shown in FIGS. 17A and 17B is rolled into a hollow cylinder.

Referring now to FIGS. 17A, 17B, and 18, a second embodiment of this invention will be described.

A pole-type antenna unit according to the second embodiment has the same external shape as that shown in FIG. 1 and differs only in the shape of a conductor pattern formed on an insulating film member. Accordingly, the same reference symbols are assigned to portions that are the same as those of the pole-type antenna unit according to the first embodiment, thereby omitting detailed explanation thereof.

The pole-type antenna unit 10 according to the second embodiment also comprises a hollow cylindrical member 11 formed by rolling a flexible insulating film member 20 as shown in FIGS. 17A and 17B into a hollow cylinder about a center axis. FIG. 17A shows a first surface 20-1 of the insulating film member 20 while FIG. 17B shows a second surface 20-2 of the insulating film member 20. The insulating film member 20 is produced by the use of a film made of a low-loss dielectric material, for example, a Teflon (registered trademark)-based material and has an antenna pattern portion 20A and a phase shifter portion 20P on the first surface 20-1 side. The antenna pattern portion 20A has a substantially parallelogram shape while the phase shifter portion 20P has a substantially rectangular shape.

The antenna pattern 20A comprises a helical pattern portion 20H formed so as to extend helically in a longitudinal direction (direction of the center axis) of the pole-type antenna unit 10 and a loop pattern portion 20L connected to an end portion of the helical pattern portion 20H at an upper end portion of the hollow cylindrical member 11.

By rolling the insulating film member 20 and connecting together a pair of lateral sides of the insulating film member 20 so that the first surface 20-1 becomes an inner peripheral surface, the hollow cylindrical member 11 as shown in FIG. 1 is formed. The connection between the pair of lateral sides is carried out, for example, by the use of double-sided adhesive tape, an adhesive agent, or soldering.

A first antenna pattern comprising first to fourth helical conductors 21', 22', 23', and 24' is formed on the first surface 20-1 of the helical antenna portion 20H. Each of the first to fourth helical conductors 21' to 24' is formed so as to extend in parallel to the lateral sides of the helical antenna portion 20H in the state where each conductor is bent four times in opposite directions in the longitudinal direction (direction of the center axis) of the pole-type antenna unit 10. Particularly, it is configured that, in each of the first to fourth helical conductors 21' to 24', at least one of five conductor patterns each extending in parallel to the lateral sides, i.e. the conductor pattern connected to a phase shifter pattern 25' in FIG. 17A, is formed in a meander shape, i.e. lying in a zigzag line.

As described above, when the insulating film member 20 is rolled so that the hollow cylindrical member 11 is formed as described above, each of the first to fourth helical conductors 21' to 24' extends in a helical fashion on the inner peripheral surface of the hollow cylindrical member 11 in the state where each conductor is bent four times in the opposite directions in the longitudinal direction of the pole-type antenna unit 10. The first antenna pattern composed of the first to fourth conductors 21' to 24' functions as a helical antenna.

As described above, in this second embodiment, since the first to fourth helical conductors 21' to 24' are each bent in the longitudinal direction of the pole-type antenna unit 10 and part of each of the helical conductors are formed in a meander shape, it is possible to lengthen the conductors. The height of the pole-type antenna unit 10 can be reduced as compared with the case where the helical conductors are not bent and further as compared with the first embodiment.

On the first surface of the loop antenna portion 20L, a second antenna pattern comprising a loop conductor 28 connected to end portions (upper end portions) of the first to fourth helical conductors 21' to 24' is formed. The second antenna pattern comprising the loop conductor 28 functions as a loop antenna.

The phase shifter pattern 25' electrically connected to the foregoing first antenna pattern is formed on the first surface 20-1 of the phase shifter portion 20P. Therefore, when the insulating film member 20 is rolled so that the hollow cylindrical member 11 is formed as described above, the phase shifter pattern 25' is formed on the inner peripheral surface of the hollow cylindrical member 11. This phase shifter pattern 25' functions as a phase shifter.

A ground pattern 27 is formed on the second surface 20-2 of the phase shifter portion 20P. That is, the ground pattern 27 is formed on the surface of the phase shifter portion 20P on the opposite side with respect to the surface thereof where the phase shifter pattern 25' is formed. Therefore, when the insulating film member 20 is rolled so that the hollow cylindrical member 11 is formed as described above, the ground pattern 27 is formed on the outer peripheral surface of the hollow cylindrical member 11 on the opposite side with respect to the surface thereof where the phase shifter pattern 25' is formed. The ground pattern 27 functions as a shield member provided so as to cover the phase shifter pattern 25'.

Each part except for parts illustrated in FIG. 17 is the same as that of the first embodiment.

As described above, in this second embodiment, since the first antenna pattern comprising the first to fourth helical conductors 21' to 24' and forming the helical antenna portion 20H and the second antenna pattern comprising the loop conductor 28 and forming the loop antenna portion 20L are formed on the inner peripheral surface 20-1 of the hollow cylindrical member 11, there is no direct contact between the first and second antenna patterns and an inner wall of the cover case 40. Therefore, antenna characteristics of the pole-type antenna unit 10 can be prevented from being affected by the cover case 40. Further, since the ground pattern 27 serving as the shield member is disposed on the outer side of the phase shifter pattern 25', the antenna characteristics of the pole-type antenna unit 10 can be prevented from being affected by the human body (hand, fingers, or the like). As a result, the pole-type antenna unit 10 according to this second embodiment can achieve desired antenna characteristics even during use. Moreover, since the pole-type antenna unit 10 no use high permittivity ceramics, it is possible to reduce the dielectric loss and is possible to provide the pole-type antenna unit 10 having high gain in low price.

Further, in the conventional antenna unit, four electromagnetic coupling lines are coupled to a loop conductor 28 through gaps defined therebetween as shown in FIG. 16A. In contrast, in the antenna unit 10 according to the second embodiment, the first to fourth helical conductors 21' to 24' are directly connected to the loop conductor 28 as shown in FIG. 17A and, therefore, the impedance matching can be easily achieved.

In FIGS. 17A and 17B, as described in detail in the first embodiment, part of the lower side of the phase shifter portion 20P in the insulating film member 20 is projected downward for forming cutouts 11*a* adapted to receive therein side end portions 321 of a board 32. However, such cutouts 11*a* are not necessarily required. That is, the lower side of the phase shifter portion 20P may be formed as shown by a chain line in FIGS. 17A and 17B. In this case, an output terminal for connection to the board 32 (low-noise amplifier 61) is formed at a portion identified by symbol 25*a*'. That is, part of the lower side of the phase shifter portion 20P is slightly projected downward and an end portion of the phase shifter pattern 25' extending to this projected portion is connected, as the output terminal 25*a*', to the low-noise amplifier 61 on the board 32.

Also in the antenna unit 10 according to the second embodiment, its antenna radiation characteristics can be changed to some degree by changing, on a design basis, a diameter of the loop conductor 28 and/or an angle of the first to fourth helical conductors 21' to 24'.

While this invention has been described in terms of the two embodiments, the invention is of course not limited to those embodiments. For example, although the four helical conductors formed on the inner peripheral surface of the hollow cylindrical member are used as the first antenna pattern in each of the foregoing embodiments, the first antenna pattern may be composed of at least one helical conductor. In the case of the single helical conductor, the phase shifter (phase shifter portion) is not required. In each of the foregoing embodiments, each of the helical conductors forming the first antenna pattern is bent twice or four times in the opposite directions in the longitudinal direction (center axis direction) of the pole-type antenna unit. However, each helical conductor may be bent at least once in the opposite direction. In each of the foregoing embodiments, the ground pattern formed on the outer peripheral surface of the hollow cylindrical member is used as a shield member. However, the shield member is not limited thereto, but may be another as long as it is provided so as to cover the phase shifter pattern. For example, the shield member may be a conductor pattern formed on the inner wall of the cover case at a portion corresponding to the portion where the phase shifter pattern is formed or a tape with a shielding effect stuck to the outer wall of the cover case at a portion corresponding to the portion where the phase shifter pattern is formed. The hollow cylindrical member 11 may be a pole-shaped member.

The pole-type antenna unit described in the embodiment is suitable as a personal-type miniature antenna unit for a digital radio receiver, but not limited thereto, and is also applicable as an antenna unit for a GPS receiver or an antenna unit for mobile communication adapted to receive other satellite waves or ground waves.

What is claimed is:

1. An antenna unit comprising:

a pole-shaped member; and an antenna pattern comprising a plurality of conductors formed on a peripheral surface of said pole-shaped member, wherein said antenna pattern comprises a helical pattern in which said plurality of conductors extend helically in a direction of a center axis of said pole-shaped member and a loop pattern connected to an end portion of said helical pattern at an upper end portion of said pole-shaped member, and wherein each of said conductors comprises a bent portion that is bent a plurality of times in opposite directions in the direction of said center axis and a meander portion in which a part of said bent portion is formed in a meander shape.

2. An antenna unit according to claim 1, wherein said pole-shaped member is a hollow cylindrical member obtained by forming a flexible insulating film member into a hollow cylinder about said center axis.

3. An antenna unit according to claim 1, further comprising a phase shifter pattern formed on the peripheral surface of said pole-shaped member and electrically connected to said helical pattern.

4. An antenna unit according to claim 3, wherein said antenna pattern and said phase shifter pattern are formed on an inner peripheral surface of said pole-shaped member, said antenna unit further comprising a ground pattern formed on an outer peripheral surface of said pole-shaped member at a portion corresponding to a portion where said phase shifter pattern is formed.

5. An antenna unit according to claim 1, further comprising a hollow cylindrical cover case covering said pole-shaped member.

6. An antenna unit according to claim 3, wherein said meander portion of each of said conductors is directly connected to said phase shifter pattern and said bent portion of each of said conductors is directly connected to said loop pattern such that said meander portion is interposed between said phase shifter pattern and said bent portion, and said bent portion is interposed between said meander portion and said loop pattern.

7. An antenna unit according to claim 1, wherein said meander portion of each of said conductors is situated alongside said bent portion of each of said conductors.

8. An antenna unit according to claim 1, wherein said conductors are arranged such that said bent portion of each of said conductors is alongside said meander portion of an adjacent one of said conductors.

* * * * *